US005842803A

United States Patent [19]

Furnell

[11] Patent Number: 5,842,803

[45] Date of Patent: Dec. 1, 1998

[54] COSMETIC CONTAINER FOR BRAKING AND CENTERING COAXIAL, TUBULAR MEMBERS

[75] Inventor: Brian Furnell, Ferndown, England

[73] Assignee: Rexam Cosmetic Packaging, Inc., Torrington, Conn.

[21] Appl. No.: 719,404

[22] Filed: Sep. 24, 1996

[51] Int. Cl.[6] ..... A45D 40/12; A45D 40/06

[52] U.S. Cl. ..... 401/78; 401/80

[58] Field of Search ..... 401/78, 80

[56] References Cited

U.S. PATENT DOCUMENTS

| | | | |
|---|---|---|---|
| 3,515,493 | 6/1970 | Gruska | 401/78 X |
| 3,620,632 | 11/1971 | Gruska | 401/78 |
| 3,850,183 | 11/1974 | Gruska | 401/78 X |
| 5,096,318 | 3/1992 | Susini et al. | 401/80 |
| 5,324,126 | 6/1994 | Holloway et al. | 401/80 X |

FOREIGN PATENT DOCUMENTS

| | | | |
|---|---|---|---|
| 2426427 | 1/1979 | France | 401/78 |
| 2639260 | 5/1990 | France | 401/78 |
| 94 08989 | 1/1996 | France . | |

*Primary Examiner*—Steven A. Bratlie

*Attorney, Agent, or Firm*—Bell Seltzer Intellectual Property Group of Alston & Bird LLP

[57] ABSTRACT

A cosmetic stick lift mechanism for a case having concentric sleeves whose respective rotation is controlled by shoe portions in the form of thin, diverging tongue portions which project from the continuous subjacent external wall of the base of the internal sleeve, with their free flexible ends oriented towards the adjacent end of the base of the sleeve.

14 Claims, 1 Drawing Sheet

COSMETIC CONTAINER FOR BRAKING AND CENTERING COAXIAL, TUBULAR MEMBERS

FIELD OF THE INVENTION

The present invention is directed to a packaging container for lipsticks and other similar substances for cosmetic, hygienic and pharmaceutical uses. It more particularly is directed to a lift mechanism for such containers, the base of which is turned with respect to the body to extend the substance in the form of a stick from the case in which it is housed, and to retract it into same between uses.

BACKGROUND OF THE INVENTION

Desirable features for lipstick containers include a smooth operation and a sleek design, which imply a lack of noticeable clearance between the movable parts. It is commercially imperative, however, to be able to manufacture containers on a mass-production scale and at a moderate cost, which excludes a high degree of accuracy in terms of the dimensions and assembly of the various elements, as well as the use of materials which are onerous to use or delicate to employ. Generally, therefore, the components of the case are produced by molding plastic materials with mechanical tolerances which are acceptable for mass production and the economy of operation of the molds, the structure of the elements compensating for play upon assembly.

Thus, structures involving combined braking and centering of the respectively rotatable coaxial elements have been designed, such as that described in French patent No. 90 00 600/2 657 238, in which those combined actions are afforded by elastic lugs which extend from a ring fixed to the internal sleeve and which come to rub against the interior of a cylindrical surface which is fixed with respect to the external sleeve. The flexible end of the lugs is directed towards the middle of the sleeve, which involves an increase in the length of the case and can give rise to some difficulties in regard to molding and assembly of the case. It has also been proposed that brake tongue portions can be produced by cutting out the wall of the sleeve, which has the disadvantage of weakening it and giving rise to undesirable deformation phenomena.

SUMMARY OF THE INVENTION

The aim of the present invention is to produce packaging cases or containers which avoid the above-described disadvantages and in which the elements are easy to mold and assemble and whose mechanism is flexible and regular in operation.

The present invention is directed to a cosmetic stick lift mechanism for a case or container with respectively rotatable concentric sleeves guiding an internal stick-carrier holder in axial translation. The external wall itself or an added element which is fixed relative to the base of the internal sleeve has, in a regularly distributed arrangement around its periphery, radially flexible brake shoe portions whose free ends rub against a smooth cooperating circular surface of the internal wall itself or the added element which is fixed with respect to the external sleeve. The brake shoe portions in the form of thin divergent tongue portions project from the continuous external subjacent wall of the base of the internal sleeve, with their free flexible ends oriented towards the adjoining end of the base of the sleeve.

Smooth operation is achieved, particularly, because the external sleeve is formed of a plastic material which is stronger than that of the internal sleeve and it is terminated at its base by a skirt with a thin wall whose smooth cylindrical interior constitutes the friction surface of the shoe portions. Therefore, it is useful for the external sleeve to be enclosed, except for the skirt, in a rigid sheath.

According to a preferred embodiment of the present invention, the internal sleeve itself, or an added element which is fixed with respect thereto, has towards its base an external annular shoulder serving as an abutment for an internal step or recess of the external sleeve at the base of the skirt. The roots of the shoe portions extend from the internal sleeve and have, at most, the same outside diameter as the shoulder. The shoe portions spread radially from their root while decreasing in thickness. The length of the shoe portions are less than that of the skirt and the internal sleeve has, at its opposite end, an external rim serving as an abutment for the end of the external sleeve which is opposite to the skirt.

In order to prevent untimely lateral movement of the stick-carrier holder during the sliding movement thereof, the internal sleeve has internally within its base at least three regularly distributed longitudinal flats serving as a lateral steadying means.

To improve the sturdiness of the base of the internal sleeve which serves as an operating button for the mechanism and on to which a decorative base portion is generally fitted, longitudinal ribs which project from the external wall or an added element which is fixed with respect to the base of the internal sleeve are interposed between the shoe portions, the diametrical envelope of the ribs being at most equal to that of the roots of the shoe portions.

In practice, the sleeves will advantageously be made from molded thermoplastic materials such as polypropylene for the internal sleeve and polystyrene or acrylonitrile-butadiene-styrene for the external sleeve, while a metal such as stamped or pressed brass may be used for the sheath.

The invention is also directed to conditioning cases for substances in stick form comprising a mechanism according to the invention.

BRIEF DESCRIPTION OF THE DRAWINGS

Enhanced understanding of the invention will result from consideration and the detailed description of the accompanying drawings which show an embodiment selected purely by way of example from the numerous possible forms of configuration, adaptations and variants of the invention which can be conceived by a person skilled in the art.

In the drawings.

DETAILED DESCRIPTION OF THE PREFERRED EMBODIMENTS

Figure 1:
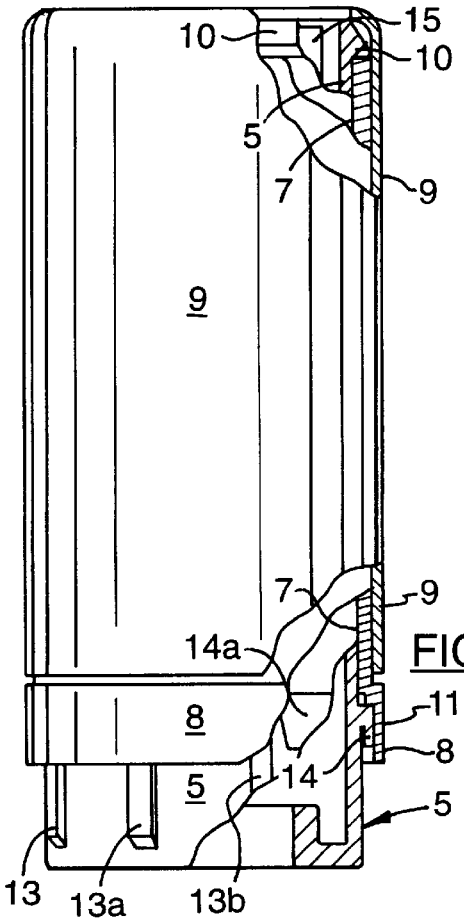
FIG. 1 is an elevational view shown in partial diametrical cross-section of a lipstick case mechanism according to the invention.
Figure 3:
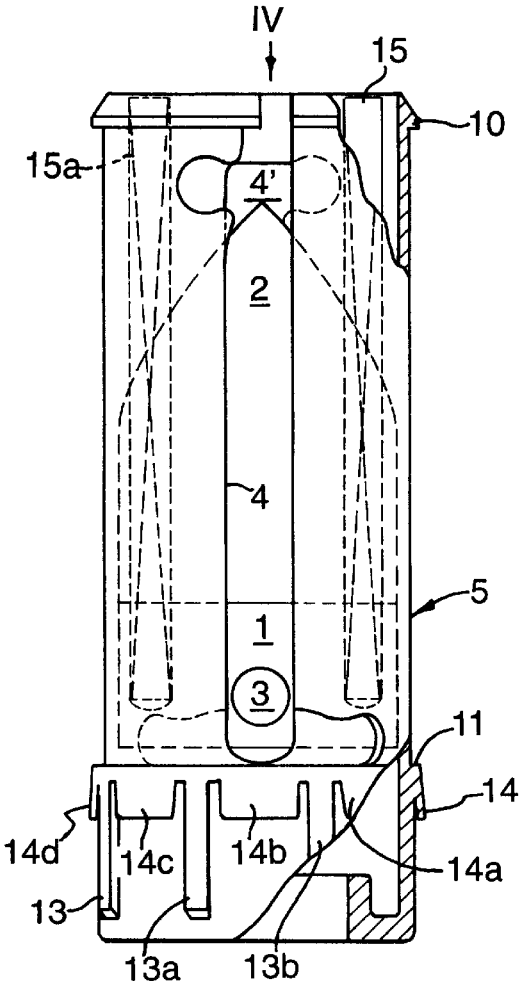
FIG. 3 is an elevational view shown in partial diametrical cross-section of the internal sleeve of the mechanism of FIG. 1.
Figure 2:
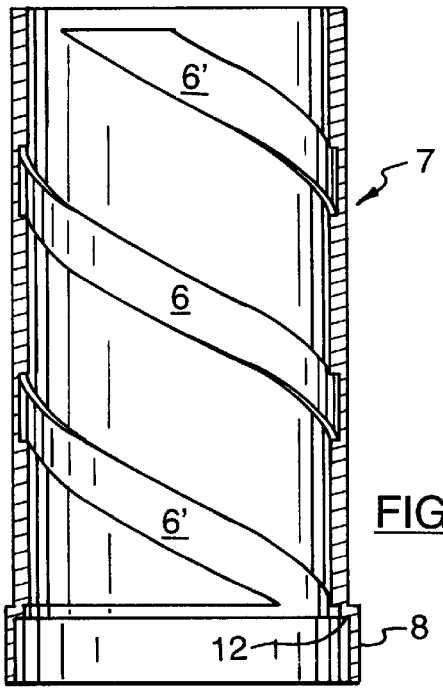
FIG. 2 is an elevational view shown in diametrical cross-section of the external sleeve of the mechanism of FIG. 1.
Figure 4:
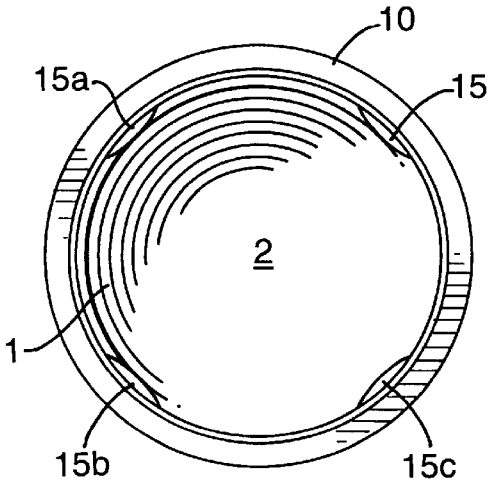
FIG. 4 is a top view from arrow IV in FIG. 3.

In the Figures the corresponding elements are denoted by the same reference numerals, possibly with the addition of an index. The respective dimensions and proportions of the elements may not be true to scale in order for the drawings to be clearer.

The lipstick case mechanism shown in the drawings essentially comprises a holder 1 carrying a lipstick 2 and having two diametrically opposite radial projections 3 which are slidable, respectively, in one of the two diametrically opposite longitudinal slots 4, 4' of an internal sleeve 5. The free ends of the projections 3 respectively slide in one of the two helical grooves 6, 6' provided in the internal wall of an external sleeve 7 which is coaxial with the internal sleeve 5. The base of the external sleeve 7 is thinner than the body and forms a skirt 8 with a smooth cylindrical internal wall. A rigid tubular sheath 9 encloses the external sleeve 7 except for the skirt 8.

At its end opposite to its base, the internal sleeve 5 has an external rim 10 serving as an abutment for the end of the external sleeve 7 which is opposite to its skirt 8. The base of the external sleeve is delimited by an external annular shoulder 11 which serves as an abutment for an internal step or recess 12 of the external sleeve 7 at the base of the skirt 8. Thus, the external sleeve 7 is axially fixed and free to rotate about the internal sleeve 5, the assembly being made rigid by the sheath 9.

Extending from the shoulder 11 of the base of the internal sleeve 5 towards the adjoining end of the sleeve are longitudinal ribs 13, 13*a*, 13*b* alternating with shoe portions 14, 14*a*, 14*b*, 14*c* which diverge radially from their root while decreasing in thickness, for example at an external angle of about 4° and an internal angle of about 12°. The free ends of the shoe portions 14 rub elastically against the interior of the skirt 8. The ribs 13 and the roots of the shoe portions 14 are of the same outside diameter as the shoulder 11, which is slightly less than the inside diameter of the skirt 8.

The internal wall of the internal sleeve 5 has four regularly distributed longitudinal flats 15, 15*a*, 15*b*, 15*c* which laterally steady the holder 1 when it performs its sliding movement within the internal sleeve.

It will advantageously be possible to make the external sleeve from a plastic material having dimensional reliability and which has a suitable coefficient of friction such as impact polystyrene or acrylonitrile-butadiene-styrene while the internal sheath will be molded from a plastic material with a good coefficient of sliding movement against the plastics material of the external sleeve and good elastic deformability such as polypropylene.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A cosmetic container having a stick lift mechanism, said container comprising internal and external rotatable concentric sleeves which guide an internal stick-carrier holder in axial translation, said external sleeve having an annular skirt with an inwardly facing cylindrical wall, said internal sleeve having a base adjacent its lower end with an outwardly facing cylindrical wall, an annular shoulder, and flexible brake shoe portions extending downwardly from said annular shoulder and being regularly distributed about the periphery of said outwardly facing wall and being defined by a plurality of thin diverging tongues configured to frictionally contact said inwardly facing wall of said external sleeve.

2. A cosmetic container according to claim 1, wherein said brake shoe portions are carried by said internal sleeve and extend radially outward therefrom.

3. A cosmetic container according to claim 1, including an added element secured to said internal sleeve, and wherein said annular shoulder and said brake shoe portions are carried by said added element and extend radially outward therefrom.

4. A cosmetic container according to claim 1 wherein said external sleeve is formed of a first material and said internal sleeve is formed of a second material wherein said first material is stronger than said second material.

5. A cosmetic container according to claim 1 wherein said skirt is carried by said external sleeve at a base thereof, said skirt having a substantially smooth interior surface for frictionally contacting said brake shoe portions.

6. A cosmetic container according to claim 5 wherein said external sleeve is partially enclosed in a rigid sheath and at least a portion of said skirt is not enclosed by said sheath.

7. A cosmetic container according to claim 5 wherein said annular shoulder is configured to abut an internal step of said external sleeve adjacent its base, wherein said shoe portions extend radially outward a distance no greater than the diameter of said annular shoulder and less than the diameter of said skirt, said shoe portions decreasing in thickness along radial lengths thereof extending from said internal sleeve, said internal sleeve comprising, at an end opposite said shoulder, an external rim for abutting a respective end of said external sleeve.

8. A cosmetic container according to claim 1 wherein said base of said internal sleeve comprises a plurality of spaced longitudinal flats for laterally supporting said stick-carrier holder during sliding movement thereof.

9. A cosmetic container according to claim 1 wherein said internal sleeve comprises a plurality of longitudinal ribs which project downwardly from said annular shoulder, each of said ribs being positioned between adjacent shoe portions.

10. A cosmetic container according to claim 1 wherein said internal sleeve is formed of a material selected from the group consisting of molded polypropylene, said external sleeve is formed of molded polystyrene or acrylonitrile-butadiene-styrene.

11. A cosmetic container according to claim 1 wherein said brake shoe portions decrease in thickness in a radial direction extending from said internal sleeve.

12. A cosmetic container according to claim 1 wherein said internal sleeve includes a longitudinal slot and said internal stick-carrier holder includes a radial projection received within said longitudinal slot and said annular shoulder is positioned below said longitudinal slot.

13. A cosmetic container having a stick lift mechanism and comprising internal and external rotatable concentric sleeves which guide an internal stick-carrier holder in axial translation, said external sleeve having an annular skirt with an inwardly facing cylindrical wall, said internal sleeve having a base adjacent its lower end with an outwardly facing cylindrical wall and an annular shoulder, flexible brake shoe portions extending downwardly from said annular shoulder and being regularly distributed about the periphery of said outwardly facing wall and being defined by a plurality of thin diverging tongues configured to frictionally contact said inwardly facing wall of said external sleeve, and a plurality of longitudinal ribs which project downwardly from said annular shoulder, each of said ribs being positioned between adjacent shoe portions.

14. A cosmetic container having a stick lift mechanism and comprising internal and external rotatable concentric sleeves which guide an internal stick-carrier holder in axial translation, said external sleeve having an annular skirt with an inwardly facing cylindrical wall, said internal sleeve having a base adjacent its lower end with an outwardly facing cylindrical wall and an annular shoulder, flexible brake shoe portions extending downwardly from said annular shoulder and being regularly distributed about the periphery of said outwardly facing wall and being defined by a plurality of thin diverging tongues configured to frictionally contact said inwardly facing wall of said external sleeve, and a longitudinal slot, and said internal stick carrier holder includes a radial projection received within said longitudinal slot, said annular shoulder being positioned on said base, beneath said longitudinal slot.

* * * * *